United States Patent [19]

Magness

[11] 4,105,125

[45] Aug. 8, 1978

[54] Z SHELF BRACKET STOCKING AND DISPLAY DEVICE

[76] Inventor: Albert H. Magness, 34 Lake Dr., Bel Air, Md. 21014

[21] Appl. No.: 772,072

[22] Filed: Feb. 25, 1977

[51] Int. Cl.[2] ..... A47F 7/00

[52] U.S. Cl. ..... 211/13; 211/49 R

[58] Field of Search ..... 211/13, 49 R, 27, 20, 211/24, 23, 28, 182, 1, 40; 248/248

[56] References Cited

U.S. PATENT DOCUMENTS

| | | | |
|---|---|---|---|
| 1,202,444 | 10/1916 | Soleau | 211/20 X |
| 1,734,997 | 11/1929 | Chubbuck | 211/27 X |
| 3,176,848 | 4/1965 | Stefan | 211/40 |
| 3,994,462 | 11/1976 | Shine | 248/248 |

*Primary Examiner*—Ramon S. Britts
*Attorney, Agent, or Firm*—J. Wesley Everett

[57] ABSTRACT

A "Z" shelf bracket stocking and display device for use by distributors and sales outlets as an aid to increased sales and greater profits. The stocking and display device of this invention is specifically arranged and constructed to support "Z" type shelf brackets which are in turn used to quickly erect shelves to hold various type items. This device has two similarly configured side members connected together by means of short spacer members to form an erect and vertical support structure. Preferably the frame members are made of tubular material appropriately connected together by welding or the like. A horizontal top connecting member of flat plate material is provided with apertures therein for supporting an appropriate, informative display sign.

2 Claims, 2 Drawing Figures

Z SHELF BRACKET STOCKING AND DISPLAY DEVICE

BACKGROUND OF THE INVENTION

1. Field of the Invention

This invention relates generally to devices used by sales outlets to stock and display shelf brackets of the "Z" type to form a storage and display unit which will help to make extra sales and increase profits.

2. Description of the Prior Art

A common problem with known type support devices for supporting hardware items and the like is that they are not properly structured to support specially configured shelf bracket hardware.

Another problem with known type devices is that they are not arranged to specifically support "Z" type shelf brackets for both stocking same as well as displaying same, and are not provided with display supporting sales generating structure to increase self-service sales.

None of the known prior art devices offers the new and unique features of the invention disclosed herein.

SUMMARY OF THE INVENTION

An object of the present invention is to provide a stocking displaying structure for specifically holding a number of "Z" shelf bracket structures.

Another object of the present invention is to provide a support structure which will hold a large number of specially configured shelf brackets in an easily seen position, and also in a manner for quick and easy self-service by a customer.

A further object of this invention is to provide a display support structure having a special mounting member provided at the top thereof for supporting informative display signs thereon for informing a potential customer desiring information about the merchandise stacked on said support.

A still further object of this invention is to provide a combination display holder together with specially configured "Z" shelf brackets for future assembly in a customer's expansion of storage with appropriate shelving thereon.

The holder and display structure of this invention offers a number of new and unique features not hitherfor found in the art. The structure is specially designed for supporting in a substantially vertical position shelf brackets of special configuration. These shelf brackets are shaped in what way be considered a "Z" figure. The purpose of the brackets is to permit quick and easy installation of shelves by a user of the brackets with the minimum of effort and installation. Two of said shelf brackets may be quickly fastened to a support wall by conventional type fastening or anchoring means and then appropriate boards placed upon the horizontal portions of said shelf brackets and between said two brackets for quickly providing 1, 2 or 3 shelves, or even more by adding additional brackets vertically in alignment with the first pair of brackets, to provide the additional shelf space needed by the consumer.

The support holder has two substantially similar side frame portions with each side portion having leg units formed therewith at the bottom thereof. The two side frame members are appropriately connected by integral, short connecting members to form the overall support structure. A flat plate member mounted between the two side frame portions at the top thereof together with apertures therein provides a convenient support member for appropriate display and advertising signs.

This support and display holder permits a several cartons or more of "Z" shelf brackets to be supported and held in a substantially vertical manner for easy viewing by potential users and customers thereof, as well as for easy self-service removal by the customer from the support structure.

These together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
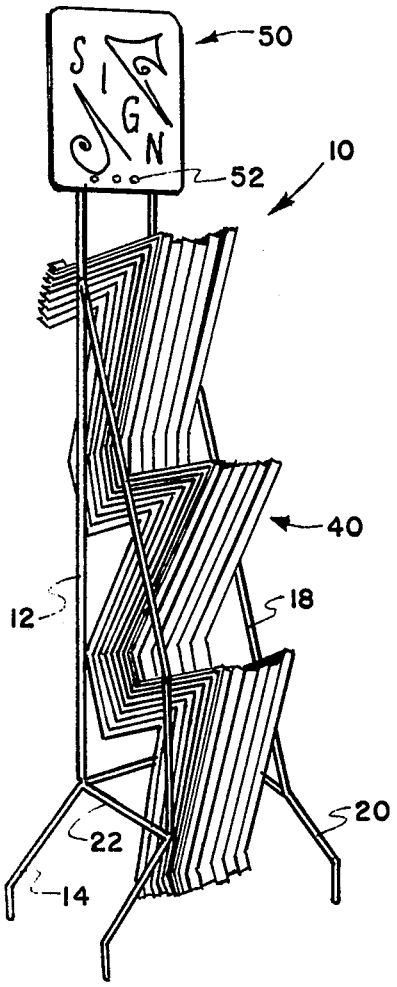
FIG. 1 is a perspective view of the support and display holder of this invention in combination with the "Z" type shelf brackets.

Referring to FIG. 1 of the drawings, reference numeral 10 indicates in general the holding and display support device of this invention. While reference numeral 40 indicates the specific "Z" type shelf brackets in combination therewith. An appropriate display and informative sign 50 may also be provided in combination with the structure. The display sign 50 is shown attached by removable nuts and bolts or the like, 52 in FIG. 1. These attach through apertures 36 in plate member 34 for secure holding of the informative sign to the overall support structure, FIG. 2.

Looking at FIG. 2 of the specific construction details of the holder will now be described. A pair of rear vertical tubular members 12 are provided having outwardly extending leg portions 14 formed as an integral part thereof. Short vertical leg portions 15 are provided as extensions of the outwardly diverging leg portions 14. Front tubular members 18 are attached by welding 23 or the like towards the top of the vertical members 12. These members 18 diverge outwardly and downwardly away from the vertical posts 12 and then have a portion 18' which are substantially parallel to the vertical post 12. Outwardly diverging leg portions 20 connecting to short vertical leg portions 21 are provided at the lower ends of the front tubular frame members 18, 18'.

A lower intermediate support 22 is provided for each of the pair of side members 12 and 18' and integrally attached thereto by welding 23. As can thus be easily visualized a pair of side frame members consisting of the portions 12, 18, and 18' are formed with outwardly extending leg portions 14, 15, and 20, 21. The connecting portions 22 complete each of the side frame structures. These two side frame structures are in turn connected securely together by means of short tubular sections 30 and again are appropriately welded 23 at each end thereof to the respective members 12. As thus constructed the basic holder is substantially completed. Preferably however, an additional plate member 34 is welded between the upper ends of vertical posts 12 to provide a support and attachment point for an appropriate selling and display sign. Apertures 36 normally are also provided in this support plate for quick and easy attachment and change of appropriate and informative display signs. Such a sign is indicated diagrammatically by reference number 50 in the view of FIG. 1.

Figure 2:
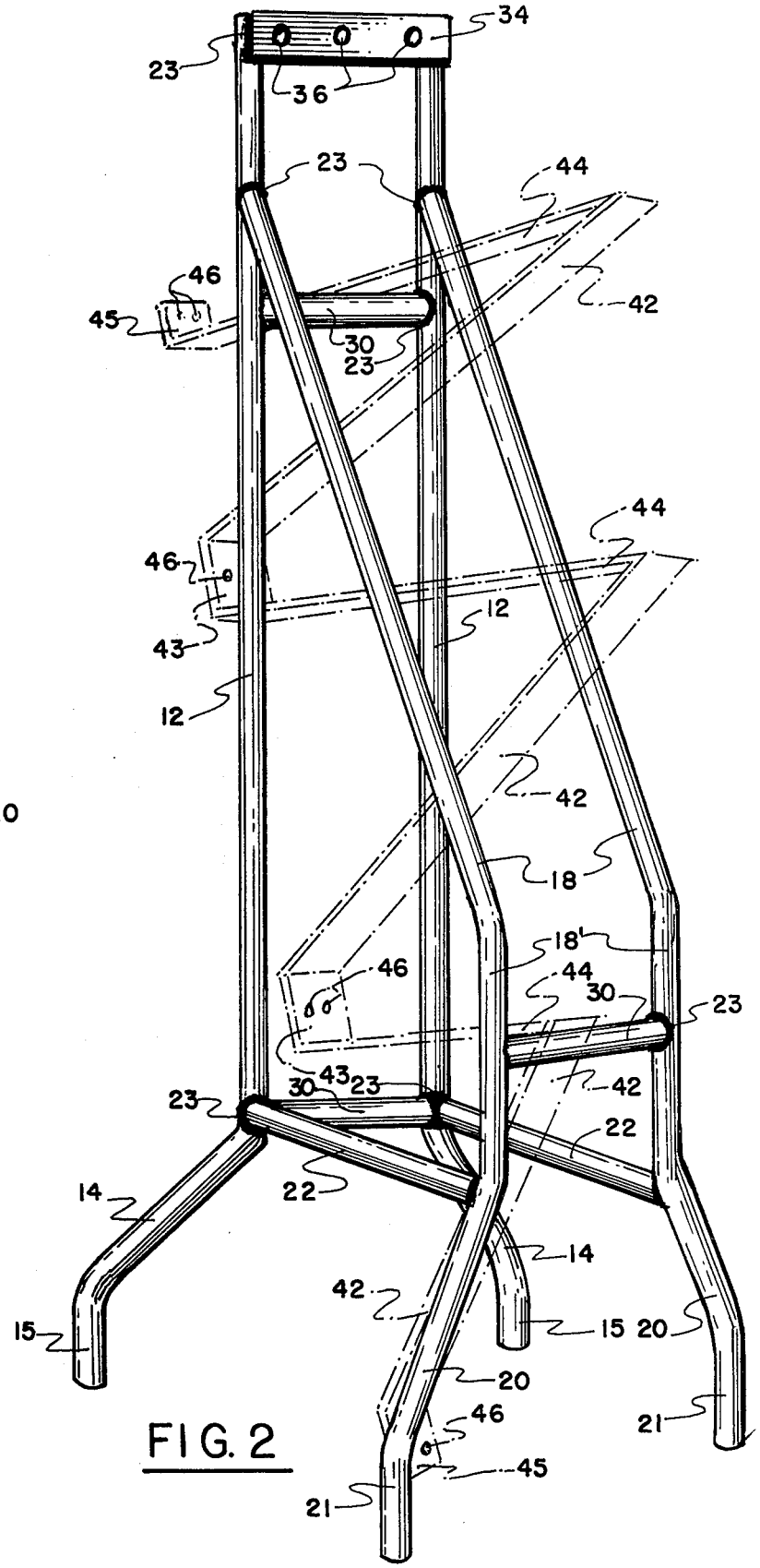
FIG. 2 is a larger perspective view showing the construction details of the device.

"Z" shaped shelf brackets for which this holder is specifically designed are shown in combination therewith in FIG. 1, and in dotted lines in FIG. 2. Each individual shelf bracket consists of the interconnecting portions 42 between the respective shelf holding members 44 and with short interconnecting portions 43. Each end of the shelf bracket is provided with an end extension 45 which is formed to lie in the same approximate plane as the connecting portions 43. Appropriate wall mounting apertures 46 are provided in these portions 43 and 45 and shown. While only a pair of holes are shown in each of the portions, three holes, four holes, or more may be provided as desired. These "Z" shelf brackets normally are attached to a wall or other vertical support structure by appropriate fastening means through the apertures 46 of the end and connecting portions 43 and 45 to attach the overall shelf bracket in a substantially vertical manner. Then appropriate boards or other shelf-type materials are supported between at least two of these brackets resting upon the substantially horizontally extending portions 44 to complete the shelf arrangement.

As can be easily visualized by looking at FIG. 2, the upper connecting portion 30 between the pair of side frame structures supports the upper member 44 of the "Z" of the "Z" bracket while the front lower connecting portion 30 supports the lower-most shelf member 44 near the apex or connection thereof between shelf support 44 and the "Z" connecting portion 42. Thus, at least two support points are provided for each of the shelf brackets as supported on the stocking and display structure of this invention.

In actual practice the following dimensions have been found to be desirable; overall height 61", width 13", and depth 28". Normally at least 108 "Z" shelf brackets can be held in combination with the support structure of this size.

This combination device of "Z" shelf brackets together with the supporting structure therefor offers a new and unique arrangement for use by many different types of selling outlets such as hardware stores, manufacturing establishments, lumber yards, and any other type of establishment selling items to the home craftsman and individual do-it-yourselfer.

The foregoing is considered as illustrative only of the principles of the invention. Further, since numberous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A display rack for displaying shelf brackets comprising:

a. a pair of narrowly spaced parallel vertical rear posts having a horizontal integrally attached connecting member adjacent the top of the two rear posts and a second horizontal integrally attached member of substantially the same length connecting the rear post members adjacent the bottom thereof;

b. a pair of front posts spaced apart substantially the same distance as the rear posts and of substantially shorter length than the said rear posts;

c. said front posts having a pair of horizontal integrally attached members extending from each front post rearwardly to each corresponding rear post adjacent the bottom of the said front and rear posts and integrally attached to said rear posts;

d. a portion of said front posts being in a plane parallel with the back posts and the remainder of the upper portion of said front posts being angled upwardly and rearwardly in the same plane with each of the corresponding rear posts and attached thereto;

e. a connecting member for said front posts of substantially the same length as the connecting members for the rear posts and integrally attached to said front posts in a horizontal plane positioned above the horizontal plane of the connecting members of the front and rear posts and positioned within the portion of the front post running parallel with the said rear post;

f. the ends of the front and rear posts below the horizontal plane of the post connecting members connecting the front and rear posts being flared laterally outwardly to engage a supporting surface.

2. In a rack as claimed in claim 1, wherein the rack is of tubular construction.

* * * * *